US010605523B2

(12) United States Patent
Davidian et al.

(10) Patent No.: US 10,605,523 B2
(45) Date of Patent: Mar. 31, 2020

(54) PROCESS AND APPARATUS FOR SEPARATING AIR BY CRYOGENIC DISTILLATION

(71) Applicant: L'Air Liquide, Societe Anonyme pour l'Etude et l'Exploitation des Procedes Georges Claude, Paris (FR)

(72) Inventors: Benoit Davidian, Saint Maur des Fosses (FR); Richard Dubettier-Grenier, La Varenne Saint Hilaire (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 738 days.

(21) Appl. No.: 15/036,447

(22) PCT Filed: Nov. 7, 2014

(86) PCT No.: PCT/FR2014/052852

§ 371 (c)(1),
(2) Date: May 13, 2016

(87) PCT Pub. No.: WO2015/071578

PCT Pub. Date: May 21, 2015

(65) Prior Publication Data

US 2016/0298900 A1 Oct. 13, 2016

(30) Foreign Application Priority Data

Nov. 14, 2013 (FR) ..... 13 61128

(51) Int. Cl.
*F25J 3/04* (2006.01)

(52) U.S. Cl.
CPC ..... *F25J 3/04412* (2013.01); *F25J 3/04169* (2013.01); *F25J 3/04181* (2013.01);
(Continued)

(58) Field of Classification Search
CPC .. F25J 3/04412; F25J 3/04448; F25J 3/04454; F25J 3/04951; F25J 3/04957; F25J 3/04963
See application file for complete search history.

(56) References Cited

U.S. PATENT DOCUMENTS 6,227,005 B1 5/2001 Higginbotham et al.
6,666,048 B1 12/2003 Brugerolle et al.
(Continued)

FOREIGN PATENT DOCUMENTS

DE 197 25 821 6/1998
DE 19951521 A1 * 5/2001 ..... F25J 3/04054
(Continued)

OTHER PUBLICATIONS

International Search Report and Written Opinion for PCT/FR2014/052852, dated Oct. 22, 2015.

*Primary Examiner* — John F Pettitt, III
(74) *Attorney, Agent, or Firm* — Justin K. Murray

(57) ABSTRACT

A process comprises a first set of distillation columns and a second set of distillation columns, a low-pressure column of the first set being connected to a column operating at higher pressure of the second set by means of a gas arriving from the top of the column operating at a higher pressure and/or by means of a fluid arriving from the low-pressure column.

20 Claims, 1 Drawing Sheet

(52) U.S. Cl.
CPC ..... *F25J 3/04448* (2013.01); *F25J 3/04454* (2013.01); *F25J 3/04957* (2013.01); *F25J 3/04963* (2013.01); *F25J 2200/10* (2013.01); *F25J 2200/20* (2013.01); *F25J 2205/62* (2013.01); *F25J 2205/66* (2013.01); *F25J 2235/42* (2013.01); *F25J 2245/42* (2013.01)

(56) References Cited

U.S. PATENT DOCUMENTS

| | | | | |
|---|---|---|---|---|
| 2007/0137248 | A1 * | 6/2007 | Le Bihan ..... | F25J 3/04054 62/646 |
| 2011/0146344 | A1 | 6/2011 | Ha et al. | |

FOREIGN PATENT DOCUMENTS

| | | | | |
|---|---|---|---|---|
| EP | 2 489 968 | | 8/2012 | |
| EP | 2 767 787 | | 8/2014 | |
| WO | WO-2013041229 | A1 * | 3/2013 | ..... F25J 3/04878 |

* cited by examiner

PROCESS AND APPARATUS FOR SEPARATING AIR BY CRYOGENIC DISTILLATION

CROSS REFERENCE TO RELATED APPLICATIONS

This application is a § 371 of International PCT Application PCT/FR2014/052852, filed Nov. 7, 2014, which claims the benefit of FR1361128, filed Nov. 14, 2013, both of which are herein incorporated by reference in their entireties.

TECHNICAL FIELD OF THE INVENTION

The present invention relates to a process and an apparatus for separating air by cryogenic distillation.

BACKGROUND OF THE INVENTION

It is known practice to separate air in a double column consisting of a medium-pressure column and a low-pressure column, the top of the medium-pressure column being thermally connected to the bottom of the low-pressure column by means of a reboiler-condenser. The medium-pressure column may for example operate at a pressure of between 5 and 6 bar abs and the low-pressure column between 1.2 and 1.5 bar abs. If the low-pressure column operates at a pressure higher than 2 bar abs, then it is commonly said that the apparatus is operating "under pressure" or "at high pressure". Distillation processes in which the apparatus operates under pressure, whether to produce impure oxygen (typically 95 mol%) or pure oxygen (typically at least 99.5 mol%) allow an approximately 20% energy saving over a conventional low-pressure design, provided that all of the nitrogen produced is put to use:

The use of pressurized designs therefore imposes two requirements:

all the nitrogen must be used some of the nitrogen will have to be impure.

The production of gaseous oxygen (GOX) and gaseous nitrogen (GAN) using two air separation units (ASUs) operating at the same low pressure (LP), and therefore with the low-pressure column operating at less than 2 bar, can be set out as follows:

| Production | Train 1: LP ASU | Train 2: LP ASU | Total |
|---|---|---|---|
| GOX | 20 | 20 | 40 |
| GAN | 10 withdrawn from the MP column<br>40 withdrawn from the LP column<br>Total GAN: 50 | 10 withdrawn from the MP column<br>40 withdrawn from the LP column<br>Total GAN: 50 | 100 |
| Energy | 100 | 100 | 200 |

In the context of a production unit having several air separation units in parallel (referred to as a "multi-train" unit), the invention proposes combining the use of a pressurized design for at least one train and a low-pressure design for at least one train.

The nitrogen needed can be produced first of all by the pressurized set, then by the low-pressure set if the requirement is higher than the maximum production of the pressurized set.

The proportion of impure nitrogen derived from the pressurized set will either be purified in the low-pressure set or purified and produced in the pressurized set using a fluid derived from the low-pressure set.

Regeneration of the pressurized set can be achieved using a residual gas from a low-pressure set.

This arrangement makes it possible to produce the desired quantity of nitrogen at the desired purity (preferably pure) and enjoy, for the production of oxygen, some of the energy saving by using low-pressure designs for some of the trains. EP-A-2489968 describes a process according to the prior art.

SUMMARY OF THE INVENTION

According to the invention, at least one set of columns of which the column operating at the lowest pressure operates at a pressure greater than 2 bar abs, referred to as "pressurized set", will be used. This set will preferably produce the nitrogen needed, in addition to some of the oxygen.

A set comprises at least one double column consisting of a medium-pressure column and a low-pressure column, the top of the medium-pressure column being thermally connected to the bottom of the low-pressure column by means of a reboiler-condenser.

One set may alternatively comprise at least a triple column consisting of three columns, a medium-pressure column, an intermediate-pressure column and a low-pressure column, the top of the medium-pressure column being thermally connected to the bottom of the intermediate-pressure column by means of a reboiler-condenser, the top of the intermediate-pressure column being thermally connected to the bottom of the low-pressure column by means of a reboiler-condenser.

One set may alternatively comprise at least a triple column consisting of three columns, a medium-pressure column, an intermediate-pressure column and a low-pressure column, the top of the medium-pressure column being thermally connected to the bottom of the intermediate-pressure column by means of a reboiler-condenser and to the bottom of the low-pressure column by means of another reboiler-condenser.

According to one subject of the invention, there is provided a process for separating air by cryogenic distillation in an apparatus comprising:

i) a first set of distillation columns comprising at least a first column operating at a first pressure referred to as high pressure and a second column operating at a second pressure lower than the first pressure, the top of the first column being thermally connected to the bottom of the second column by means of a reboiler-condenser, a first purification unit and a first heat exchange line, and ii) a second set of distillation columns comprising at least a third column operating at a third pressure lower than the first pressure and a fourth column operating at a fourth pressure lower than the first, the second and the third pressures, the top of the third column being thermally connected to the bottom of the fourth column by means of a reboiler-condenser, a second purification unit and a second heat exchange line, in which compressed air is sent to the first purification unit, purified air is sent from the first purification unit to the first exchange line, cooled air is sent from the first exchange line to the first column, compressed air is sent to the second purification unit, purified air is sent from the second purification unit to the second exchange line and cooled air is sent from the second exchange line to the third column operating at the third pressure, characterized in that a head fluid is sent from the third column to the second column or the head gas from the third column is mixed with a head gas from the second column, and an intermediate fluid from the second column is sent to the third column.

According to other optional features:

the third pressure is higher than, lower than or equal to the second pressure.

The third pressure is equal to the second pressure and the head fluid is sent from the third column to the second column without expanding it and/or the intermediate fluid is sent from the second column to the third column without pressurizing it.

The third pressure is greater than the second pressure and the head fluid is sent from the third column to the second column after having expanded it and/or the intermediate fluid from the second column to the third column after having pressurized it.

A gas, possibly an intermediate gas, is sent from the fourth column to the first purification unit and to the second purification unit to be used as a regeneration gas.

No gas is sent from the second column to the first purification unit as regeneration gas.

An oxygen-enriched fluid is withdrawn from the bottom of the second column and an oxygen-enriched fluid is withdrawn from the bottom of the fourth column.

A nitrogen-enriched gas is withdrawn from the top of the second column and a nitrogen-enriched gas is withdrawn from the top of the fourth column.

No nitrogen-enriched gas is withdrawn at the top of the first column.

Another subject of the invention provides for an air separation apparatus comprising a first air separation unit comprising i) a first set of distillation columns comprising at least a first column capable of operating at a first pressure referred to as high pressure and a second column capable of operating at a second pressure lower than the first pressure, the top of the first column being thermally connected to the bottom of the second column by means of a reboiler-condenser, a first purification unit and a first heat exchange line, means for sending compressed air to the first purification unit, means for sending purified air from the first purification unit to the first exchange line and means for sending cooled air from the first exchange line to the first column, and ii) a second set of distillation columns comprising at least a third column capable of operating at a third pressure lower than the first pressure and a fourth column capable of operating at a fourth pressure lower than the first, the second and the third pressures, the top of the third column being thermally connected to the bottom of the fourth column by means of a reboiler-condenser, a second purification unit and a second heat exchange line, means for sending compressed air at the third pressure to the second purification unit, means for sending purified air from the second purification unit to the second exchange line and means for sending cooled air from the second exchange line to the third column, characterized in that it comprises means for sending a head fluid from the third column to the second column or to the head gas of the second column and means for sending an intermediate fluid from the second column to the third column.

According to other optional aspects:

the means for sending a head fluid from the third column to the second column or to the head gas of the second column do not comprise expansion means and/or the means for sending an intermediate fluid from the second column to the third column do not comprise a pressurizing means.

The apparatus comprises a valve or a turbine to expand the fluid sent from the third column to the second column and/or a pump for pressurizing the fluid sent from the second column to the third column, the fluid being a liquid.

The apparatus comprises means for sending a gas, possibly an intermediate gas, from the fourth column to the first purification unit and to the second purification unit to act as a regeneration gas.

The apparatus does not comprise any means of sending gas from the second column to the first purification unit as regeneration gas.

The apparatus comprises means for withdrawing an oxygen-enriched fluid from the bottom of the second column and comprises means for withdrawing an oxygen-enriched fluid from the bottom of the fourth column.

The apparatus comprises a pipe for withdrawing a nitrogen-enriched gas from the top of the second column and a pipe for withdrawing a nitrogen-enriched gas from the top of the fourth column.

The apparatus does not comprise a pipe for withdrawing a nitrogen-enriched gas from the top of the first column.

The medium-pressure column of the pressurized set preferably operates at a pressure greater than 7 bar abs.

The residual nitrogen from the pressurized set or sets is purified using the low-pressure set or sets.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Example:

| Production | Train 1: Pressurized ASU | Train 2: LP ASU | Total |
|---|---|---|---|
| GOX | 20 | 20 | 40 |
| GAN | 0 withdrawn from the "MP" column<br>60 withdrawn from the "LP" column<br>20 impure withdrawn from the "LP" column and purified using train 2<br>Total GAN: 80 | 10 withdrawn from the "MP" column<br>10 withdrawn from the LP column<br>Total GAN: 20 | 100 |
| Energy | 80 | 100 | 180 |

In this case, that makes it possible to reduce the mean production energy by 10%.

Figure 1:
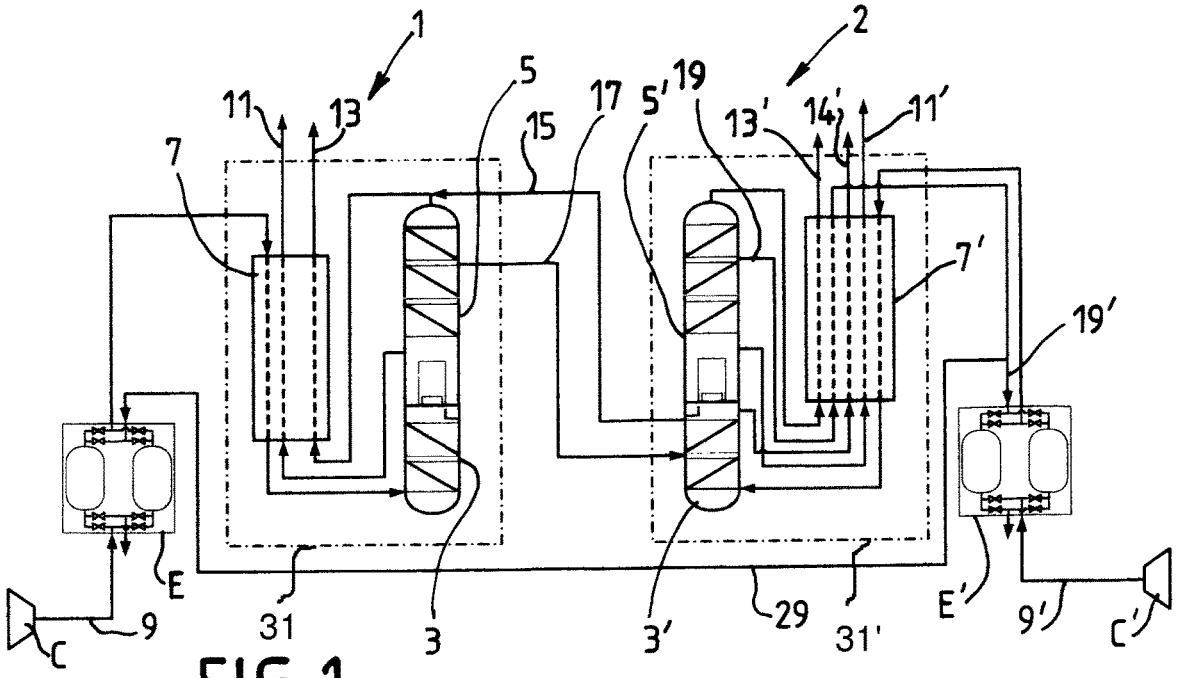
FIG. 1 represents a process flow diagram in accordance with an embodiment of the present invention.

According to FIG. 1, the apparatus comprises two sets of air separation columns 1, 2. Each set is arranged in a cold box 31, 31' but the two sets could be located inside the same cold box. In the set 1 there is at least one double separation column comprising a first column 3 operating at a first pressure referred to as a high pressure (HP) and a second column 5 operating at a second pressure not as high as the high pressure and which are thermally connected by means of at least one reboiler-condenser. The first pressure (high pressure) is greater than 7 bar abs and/or the second pressure (low pressure) is greater than 2 bar abs.

The columns 3, 5 of the set 1 illustrated are thermally connected by a bottom vaporizer of the second column 5 which condenses nitrogen coming from the top of the column 3. Air 9 compressed in the compressor C is purified in the purification unit E and cooled in the exchange line 7. The cooled air is sent at least to the first column 3 at least in part in gaseous form and there it separates in the known way. Gaseous oxygen 11 is withdrawn from the bottom of the second column 5 and heats up in the exchange line 7. Gaseous nitrogen 13 taken from the top of the second column 5 warms up in the exchange line 7. A nitrogen-enriched gaseous flow 17 is withdrawn at an intermediate level from the second column 5.

The diagram is simplified and does not show (all of) any subcoolers, pumps, booster compressors or turbines there might be.

In the set 2, there is at least one double separation column comprising a third column 3' operating at a third pressure, referred to as a medium pressure (MP) lower than the high pressure and a fourth column 5' operating at a fourth pressure not as high as the third pressure ("medium pressure"). The third pressure is less than 6.5 bar abs.

The columns 3', 5' of the set 2 are thermally connected by a bottom vaporizer of the column 5' which condenses nitrogen coming from the top of the column 3'. Air 9' compressed in the compressor C is purified in the purification unit E' and cooled in the exchange line 7'.

The cooled air is sent at least to the column 3' at least in part in gaseous form where it separates in the known way. Gaseous oxygen 11' is withdrawn from the bottom of the fourth column 5' and heats up in the exchange line 7'. Gaseous nitrogen 13' taken from the top of the fourth column 5' heats up in the exchange line 7'. Residual nitrogen 19 is withdrawn at an intermediate level of the fourth column 5'.

The residual gaseous nitrogen 17 of the set 1 derived from the second column 5 is sent to the upper part of the third column 3' of the set 2 to be purified, using the excess reflux in this part of the third column 3'. The purified nitrogen 15 is withdrawn in gaseous form at the top of the third column 3' of the set 2 (in addition to the MP nitrogen produced "naturally" by this third column 3'), and is then mixed with the nitrogen from the top of the second column 5 of the set 1 (toward the exchange line 7) so as not to unsettle the refrigeration balance.

A part 29 of the residual 19 of the set 2 is used to regenerate the purification E of set 1. The remainder 19' of the residual nitrogen 19 from the set 2 is used to regenerate the purification E' of set 2.

This alternative form makes it necessary to have the second column 5 of set 1 at a pressure substantially identical to that of the third column 3' of set 2.

Figure 2:
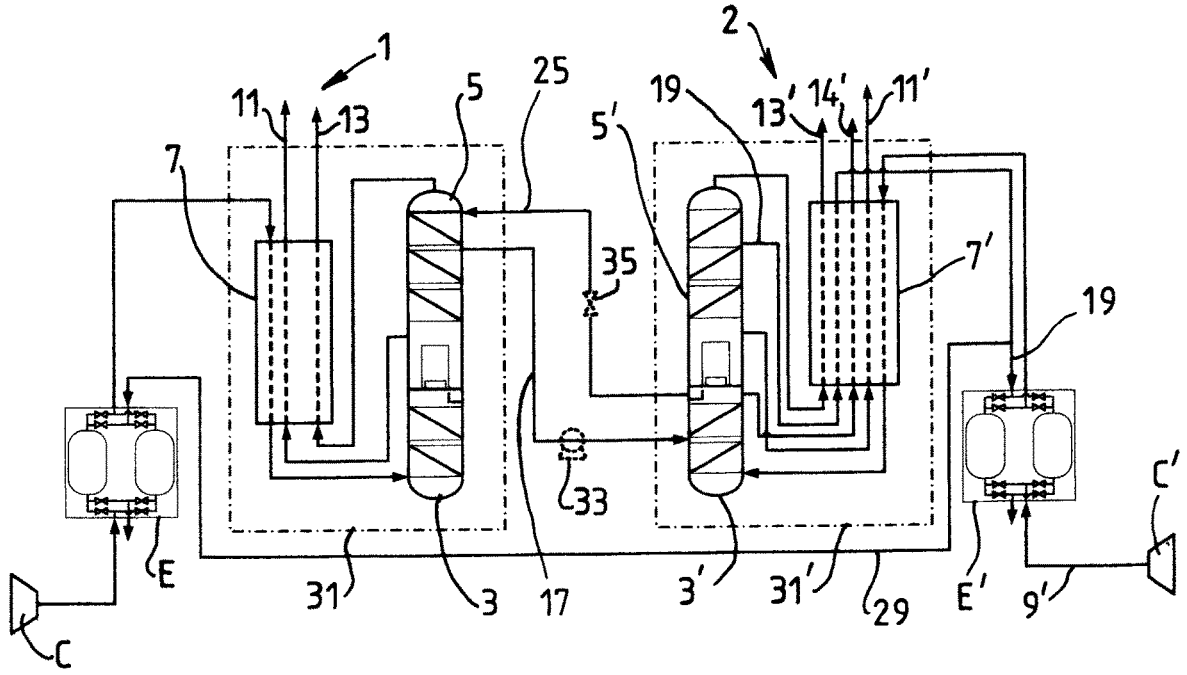
FIG. 2 represents a process flow diagram in accordance with an embodiment of the present invention.

In the alternative form of FIG. 2, the first column 3 of set 1 operates at a first pressure higher than 7 bar abs and/or the second column 5 operates at a second pressure higher than 2 bar abs.

For the set 2, the third column 3' operates at a third pressure lower than 6.5 bar abs and/or the fourth column 5' operates at a fourth pressure lower than 2 bar abs.

A part of the reflux liquid 25 available at the top of the third column 3' of the set 2 is sent, after potential expansion in a valve 35, to the top of the second column 5 of set 1 to purify the residual gas. The liquid 17 used to purify the residual nitrogen is sent back from the set 1 to an intermediate level of the column 3' of the set 2, possibly using a pump.

As use is made of liquids that can easily be pumped without too great an energy penalty, this alternative form makes it possible to decouple the pressure of the column 5 operating at the lowest pressure in the set 1 from that 3' operating at the highest pressure in the set 2.

These differences aside, the sets in FIG. 2 operate like those of FIG. 1.

In the less probable circumstance in which the third pressure of the third column is lower than the second pressure of the second column, the liquid 17 may be expanded and the liquid 25 pressurized by a pump.

The two figures show two separation sets, each comprising a double column. It will be readily appreciated that a set could comprise a triple column in place of the double column.

In particular, it is possible to conceive of a circumstance in which the set 1 comprises a triple column and the set 2 a double column. In such a case, it would be the column of the set 1 operating at the lowest pressure that would be connected to the column of the set 2 operating at the highest pressure.

In addition, the set could comprise an argon column. For example, the set 2 could comprise an argon column connected to the column 5'.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for separating air by cryogenic distillation in an apparatus comprising:

i) a first distillation system comprising a first column operating at a first pressure and a second column operating at a second pressure lower than the first pressure, a top portion of the first column being thermally connected to a bottom portion of the second column by a first reboiler-condenser, wherein the first distillation system further comprises a first purification unit and a first heat exchange line; and ii) a second distillation system comprising a third column operating at a third pressure lower than the first pressure and a fourth column operating at a fourth pressure lower than the first pressure, the second pressure and the third pressure, wherein a top portion of the third column is thermally connected to a bottom portion of the fourth column by a second reboiler-condenser, wherein the second distillation system further comprises a second purification unit and a second heat exchange line, the process comprising:

sending a first compressed air to the first purification unit to produce a first purified air;

sending the first purified air from the first purification unit to the first exchange line to produce a first cooled air;

sending the first cooled air from the first exchange line to the first column for rectification of the first cooled air;

sending a second compressed air to the second purification unit to produce a second purified air;

sending the second purified air from the second purification unit to the second exchange line to produce a second cooled air;

sending the second cooled air from the second exchange line to the third column for rectification of the second cooled air;

sending a head fluid from the top portion of the third column to the second column or mixing the head fluid from the top portion of the third column with a head gas from the second column; and sending an intermediate fluid from the second column to the third column.

2. The process as claimed in claim 1, wherein the third pressure is higher than, lower than or equal to the second pressure.

3. The process as claimed in claim 2, wherein the third pressure is equal to the second pressure and the head fluid is sent from the third column to the second column or to the head gas of the second column without expanding the head fluid.

4. The process as claimed in claim 3, wherein the intermediate fluid is sent from the second column to the third column without pressurizing the intermediate fluid.

5. The process as claimed in claim 2, wherein the third pressure is greater than the second pressure and the head fluid is sent from the third column to the second column or mixed with the head gas of the second column after having expanded the head fluid from the third column.

6. The process as claimed in claim 5, wherein the intermediate fluid is sent from the second column to the third column after having pressurized the intermediate fluid.

7. The process as claimed in claim 1, wherein a gas is sent from the fourth column to the first purification unit and to the second purification unit and using said gas as a regeneration gas within the first purification unit and the second purification unit.

8. The process as claimed in claim 7, wherein no gas is sent from the second column to the first purification unit as regeneration gas.

9. The process as claimed in claim 1, wherein an oxygen-enriched fluid is withdrawn from the bottom of the second column and an oxygen-enriched fluid is withdrawn from the bottom of the fourth column.

10. An air separation apparatus comprising a first air separation unit comprising:

i) a first distillation system comprising a first column configured to operate at a first pressure and a second column configured to operate at a second pressure lower than the first pressure, a top portion of the first column being thermally connected to a bottom portion of the second column by a reboiler-condenser, wherein the first distillation system further comprises a first purification unit and a first heat exchange line, wherein the first purification unit is in fluid communication with the first heat exchange line, wherein the first heat exchange line is in fluid communication with the first distillation system;

ii) a second distillation system comprising a third column configured to operate at a third pressure lower than the first pressure and a fourth column configured to operate at a fourth pressure lower than the first pressure, the second pressure, and the third pressure, a top portion of the third column being thermally connected to a bottom portion of the fourth column by a second reboiler-condenser, wherein the second distillation system further comprises a second purification unit and a second heat exchange line, wherein the second purification unit is in fluid communication with the second heat exchange line, wherein the second heat exchange line is in fluid communication with the second distillation system;

means for sending a head fluid from the top portion of the third column to the second column or to a head gas pipe of the second column; and means for sending an intermediate fluid from the second column to the third column.

11. The apparatus as claimed in claim 10, wherein the means for sending a head fluid from the third column to the second column or to the head gas of the second column do not comprise expansion means.

12. The apparatus as claimed in claim 10, wherein the means for sending an intermediate fluid from the second column to the third column do not comprise a pressurizing means.

13. The apparatus as claimed in claim 10, further comprising a valve or a turbine to expand the head fluid sent from the top portion of the third column to the second column.

14. The apparatus as claimed in claim 10, further comprising a pump configured to pressurize the intermediate fluid sent from the second column to the third column.

15. The apparatus as claimed in claim 10, wherein the fourth column is in fluid communication with the first purification unit and the second purification unit, such that the apparatus is configured to send a gas from the fourth column to the first purification unit and to the second purification unit to act as a regeneration gas.

16. The apparatus as claimed in claim 10, further comprising an absence of any means of sending gas from the second column to the first purification unit as regeneration gas.

17. The process as claimed in claim 1, wherein during the step of sending the intermediate fluid from the second column to the third column, the intermediate fluid does not change composition when sent from the second column to the third column.

18. The process as claimed in claim 1, wherein during the step of sending the intermediate fluid from the second column to the third column, the intermediate fluid is sent directly from the second column to the third column.

19. The process as claimed in claim 1, wherein during the step of sending the head fluid from the top portion of the third column to the second column or mixing the head fluid from the top portion of the third column with the head gas from the second column, the head fluid from the top portion of the third column is sent to the second column or mixed with the head gas from the second column without changing composition.

20. The process as claimed in claim 1, wherein during the step of sending the head fluid from the top portion of the third column to the second column or mixing the head fluid from the top portion of the third column with the head gas from the second column, the head fluid from the top portion of the third column is sent directly to the second column or directly mixed with the head gas from the second column.

* * * * *